US007527043B2

(12) United States Patent
Burkitt

(10) Patent No.: US 7,527,043 B2
(45) Date of Patent: May 5, 2009

(54) LIQUID FUEL SYSTEM WITH ANTI-DRAINBACK VALVE AND ENGINE USING SAME

(75) Inventor: Joseph Burkitt, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/825,188

(22) Filed: Jul. 5, 2007

(65) Prior Publication Data

US 2009/0007892 A1 Jan. 8, 2009

(51) Int. Cl.
*F02M 37/00* (2006.01)
*F02M 37/20* (2006.01)

(52) U.S. Cl. ..... 123/510; 123/514; 123/516

(58) Field of Classification Search ..... 123/446, 123/447, 467, 516, 179.16, 179.17, 514
See application file for complete search history.

(56) References Cited

U.S. PATENT DOCUMENTS 5,598,817 A * 2/1997 Igarashi et al. ..... 123/179.17
5,731,515 A * 3/1998 Tominaga et al. ..... 73/114.41
5,839,413 A 11/1998 Krause et al.
5,878,718 A * 3/1999 Rembold et al. ..... 123/456
5,899,193 A 5/1999 Betz, II et al.
5,911,208 A 6/1999 Furusawa et al.
5,918,578 A * 7/1999 Oda ..... 123/456
6,058,912 A * 5/2000 Rembold et al. ..... 123/516
6,065,436 A * 5/2000 Koga et al. ..... 123/179.17
6,135,090 A * 10/2000 Kawachi et al. ..... 123/446
6,352,067 B1 * 3/2002 Genslak ..... 123/510
6,408,825 B1 * 6/2002 Enoki et al. ..... 123/467
6,415,770 B1 * 7/2002 Kojima ..... 123/511
6,463,908 B1 10/2002 Gibson et al.
6,497,217 B2 * 12/2002 Kojima ..... 123/456
6,510,843 B2 * 1/2003 De Matthaeis ..... 123/506
6,615,807 B2 * 9/2003 Rembold et al. ..... 123/516
6,622,708 B2 * 9/2003 Braun et al. ..... 123/516
6,701,900 B1 3/2004 Millar et al.
6,769,414 B2 * 8/2004 Rembold et al. ..... 123/514
6,792,915 B2 * 9/2004 Rembold et al. ..... 123/446
6,805,105 B2 * 10/2004 Kato et al. ..... 123/514
6,817,343 B1 11/2004 Greco et al.
6,889,656 B1 * 5/2005 Rembold et al. ..... 123/446
6,959,697 B2 * 11/2005 Kojima ..... 123/516
7,066,152 B2 * 6/2006 Stroia et al. ..... 123/467
7,089,914 B2 * 8/2006 Joos et al. ..... 123/456
7,267,108 B2 * 9/2007 Barylski et al. ..... 123/457
7,281,520 B2 * 10/2007 Klenk et al. ..... 123/446
2001/0039944 A1 * 11/2001 Braun et al. ..... 123/510
2004/0250795 A1 * 12/2004 Stroia et al. ..... 123/447

* cited by examiner

*Primary Examiner*—Thomas N Moulis
(74) *Attorney, Agent, or Firm*—Liell & McNeil

(57) ABSTRACT

An engine with a high pressure common rail fuel system includes a bleed line to tank to facilitate evacuation of air and vapor from the fuel lines to assist in priming the fuel system. An anti-drainback valve prevents fuel vapor from migrating in a reverse direction through the bleed line toward the fuel pump during long periods of engine shut down. The inclusion of the anti-drainback valves helps facilitate short cranking times on the order of three seconds or less during engine start up, even after prolonged periods of engine shut down.

19 Claims, 3 Drawing Sheets

LIQUID FUEL SYSTEM WITH ANTI-DRAINBACK VALVE AND ENGINE USING SAME

TECHNICAL FIELD

The present disclosure relates generally to liquid fuel systems for engines, and more particularly to an anti-drainback valve for preventing vapor migration into the fuel system during engine shut down.

BACKGROUND

Most liquid fuel systems for internal combustion engines include one or more pumps and valves for delivering pressurized fuel to combustion chambers of the engine. In higher pressure fuel systems, such as those typically referred to as common rail fuel systems, priming the fuel system can be problematic. For instance, after a filter change or other servicing, some air may enter the system. Typically, this air must be evacuated by priming the system prior to starting the engine. Because the system operates at such high pressures, the fuel system may include a bleed line with a bleed orifice that allows trapped vapor to be evacuated back to the tank during a priming operation, rather than requiring the priming strategy to overcome relatively high opening pressures of regulating valves within the fuel system. Thus, a bleed line may help facilitate quicker priming of a fuel system, but such a strategy is not without consequences. For instance, during prolonged periods of engine shut down, vapor from the tank can migrate into the fuel system in a reverse direction along the bleed line. While fuel vapor entering the fuel system in this manner is not a problem, it can be perceived as a problem due to the extra engine cranking time necessary to evacuate the fuel vapor back to tank prior to engine start up. Thus, the fuel system may be working perfectly, but an operator may perceive a problem with engine cranking times on the order of three to ten seconds necessary to evacuate the fuel vapor from the fuel system prior to engine start.

The present disclosure is directed to at least one of the problems set forth above.

SUMMARY OF THE DISCLOSURE

In one aspect, an engine includes a housing with a plurality of combustion chambers disposed therein. A common rail fuel system is attached to the housing and includes a bleed line to tank, and an anti-drainback valve operably positioned in the fuel system to prevent fuel vapor from migrating from the fuel tank toward a pump when the engine is shut down.

In another aspect, a liquid system for an engine includes a low pressure transfer pump with an inlet fluidly connected to a tank. A high pressure pump has an inlet fluidly connected to an outlet of the transfer pump, and an outlet fluidly connected to the tank via a bleed line that includes a bleed orifice. A high pressure reservoir has an inlet fluidly connected to the outlet of the high pressure pump. An anti-drainback valve is fluidly positioned between a pump side of the bleed orifice and the tank.

In still another aspect, a method of operating an engine includes evacuating vapor from fuel lines of a common rail fuel system to a fuel tank via a bleed line when a fuel pump is moving. Migration of vapor from the fuel tank through the bleed line toward the fuel pump is prevented when the engine is shut down by closing an anti-drainback valve of the common rail fuel system.

DETAILED DESCRIPTION

Figure 1:
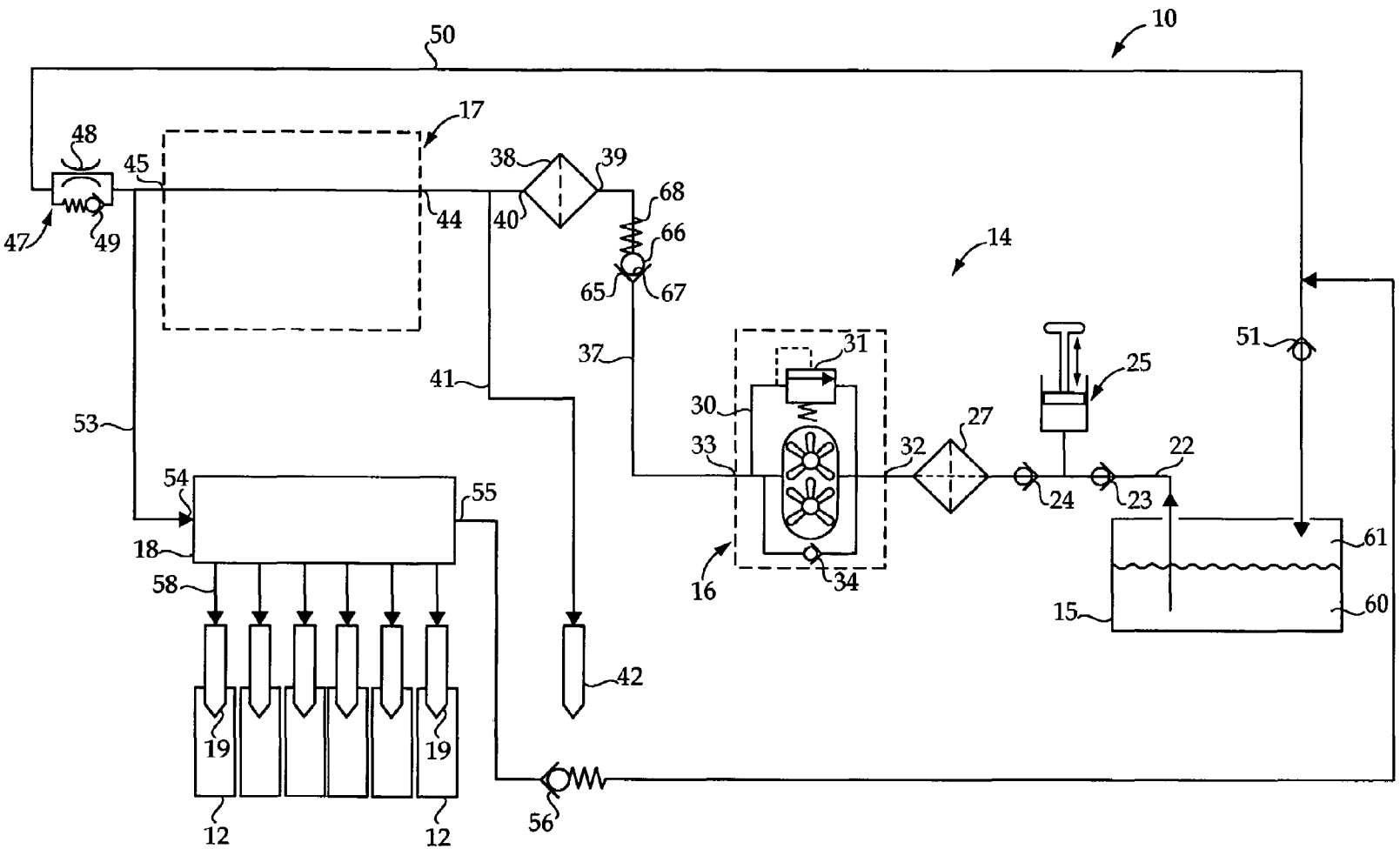
FIG. 1 is a schematic illustration of an engine according to one aspect of the present disclosure.

Referring to FIG. 1, an engine 10 includes a plurality of combustion chambers 12 and a liquid fuel system 14. Those skilled in the art will appreciate that the present disclosure is illustrated in the context of a common rail fuel system for a direct injection diesel type engine. However, the present disclosure is also applicable to other liquid systems for engines, including but not limited to high pressure hydraulic systems, and various high pressure liquid systems associated with spark ignition engines. In the illustrated embodiment, liquid fuel system 14 includes a fuel tank 15 that typically contains an amount of liquid fuel 60 and vapor 61. A relatively low pressure fuel transfer pump 16 includes an inlet 32 fluidly connected to tank 15 via a supply line 22. In the illustrated embodiment, a hand priming pump 25 is fluidly connected to supply line 22 between a pair of check valves 23 and 24. Supply line 22 also includes a large particle filter upstream of the inlet 32 of transfer pump 16. In the illustrated embodiment, fuel transfer pump 16 is gear driven directly by engine 10 in a well known manner to produce more fuel than that required by the engine across its operating range. Those skilled in the art will appreciate that low pressure fuel transfer pump 16 can also be electrically driven and may take other forms other than that shown here. For instance, in the illustrated embodiment, transfer pump 16 includes an internal passageway with a check valve 34 that circumvents the pumping mechanism to facilitate priming the entire fuel system 14. In addition, transfer pump 16 may include an internal recirculation line 30 with an inlet fluidly connected adjacent an outlet 33 of transfer pump 16 and an outlet of the recirculation line connected to the inlet 32 of transfer pump 16. A pressure regulating valve 31 opens to allow any excess fuel produced by transfer pump 16 to simply be recirculated back to the inlet 32. Nevertheless, those skilled in the art will appreciate that other systems may include fluid passageways not associated with pump 16 to facilitate priming and/or pressure regulation.

The inlet 44 of a high pressure pump 17 is fluidly connected to the outlet 33 of fuel transfer pump 16 via a circulation line 37. An anti-drainback valve 65 is positioned in circulation line 37, and includes a valve member 66 biased into contact with a conical valve seat 67 via a biasing spring 68. The pre-load on biasing spring 68 need only be sufficient to urge the valve member into seat 67 to close circulation line 37 when pump 16 is not operating. Those skilled in the art will appreciate that if anti-drainback valve 65 were mounted in a vertical orientation, it might be possible that gravity could supply the necessary bias to urge valve member 66 into contact with valve seat 67. Thus, in some circumstances, biasing spring 68 may be eliminated. A small particle filter 38, which includes an inlet 39 and an outlet 40 is fluidly connected in circulation line 37 and serves to trap any small particulate matter that may have entered fuel system 14 prior to the fuel reaching high pressure pump 17. Although not necessary, an aftertreatment supply line 41 may connect to circulation line 37, and provide means by which fuel may be delivered to an aftertreatment or regeneration fuel injector 42 that is positioned in the exhaust system for such purposes as regenerating diesel particulate filters. Nevertheless, those skilled in the art will appreciate that other engines may include different strategies for exhaust aftertreatment which may or may not include fuel delivery as in the illustrated engine 10.

High pressure pump 17 may be of any suitable design and may be fixed or variable displacement depending upon the control strategy of the particular fuel system. An outlet 45 from high pressure pump is fluidly connected to an inlet 54 of a common rail 18 via a high pressure line 53. Individual fuel injectors 19 are fluidly connected to common rail 18 via individual branch passages 58 in a manner well known in the art. Each of the fuel injectors 19 is positioned for direct fuel injection into individual engine cylinders 12 in a manner well known in the art. Common rail 18 may also include an outlet 55 that is fluidly connected to tank 15 via a pressure regulating valve 56, which may be set to open only when pressure exceeds some predetermined high magnitude. The outlet of high pressure pump 17 is also fluidly connected to the vapor portion 61 of fuel tank 15 via a bleed line 50. Bleed line 50 may include a bleed orifice 48, which may be part of a pressure regulator 47, which includes a pressure regulating valve 49. Bleed orifice 48 may be of any suitable size but may be on the order of a half millimeter in diameter to facilitate evacuation of air from fuel system 14 during priming and the like without the need to push any trapped air past a pressure regulating valve in order to evacuate the same. Bleed line 50 may also include a check valve 51.

Figure 2:
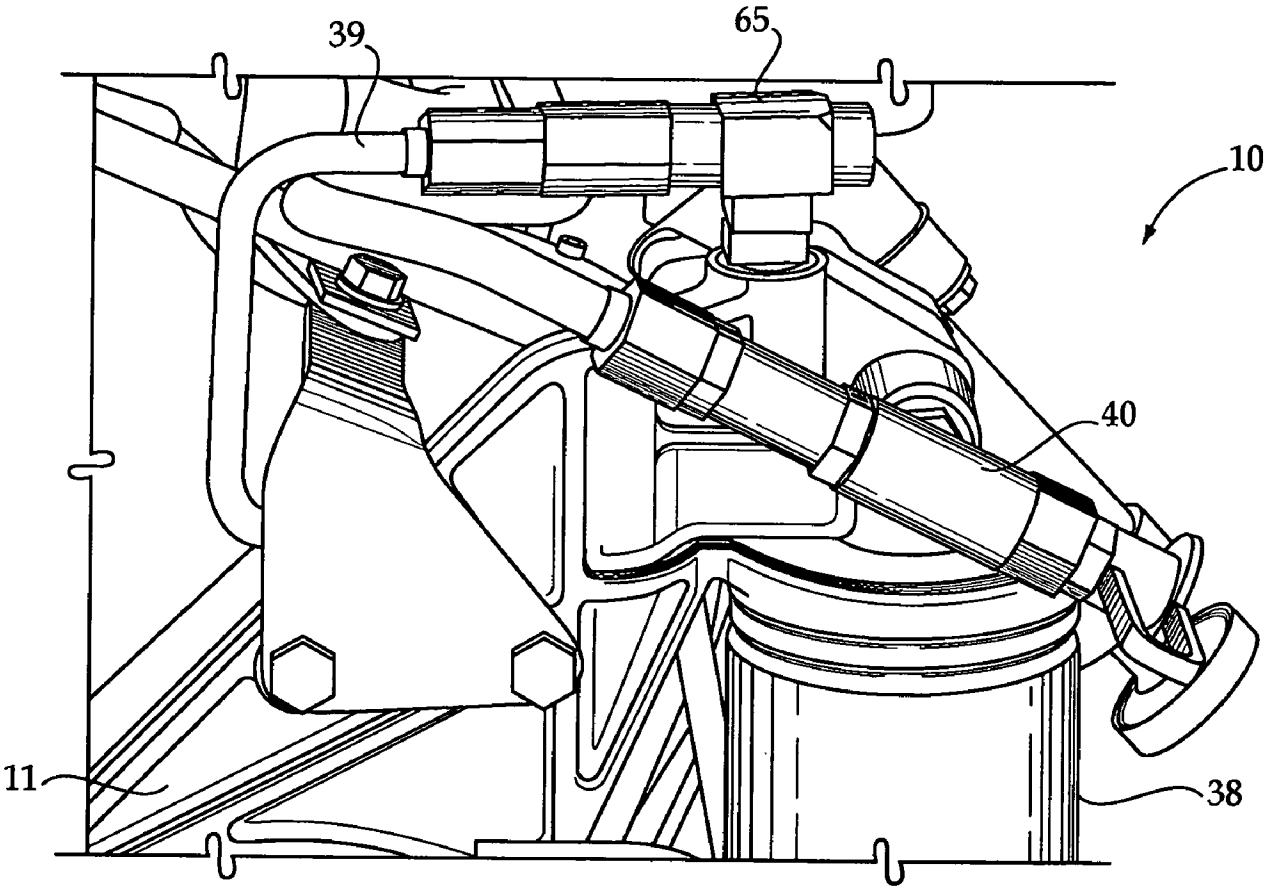
FIG. 2 is a perspective view of a portion of the engine of FIG. 1.
Figure 3:
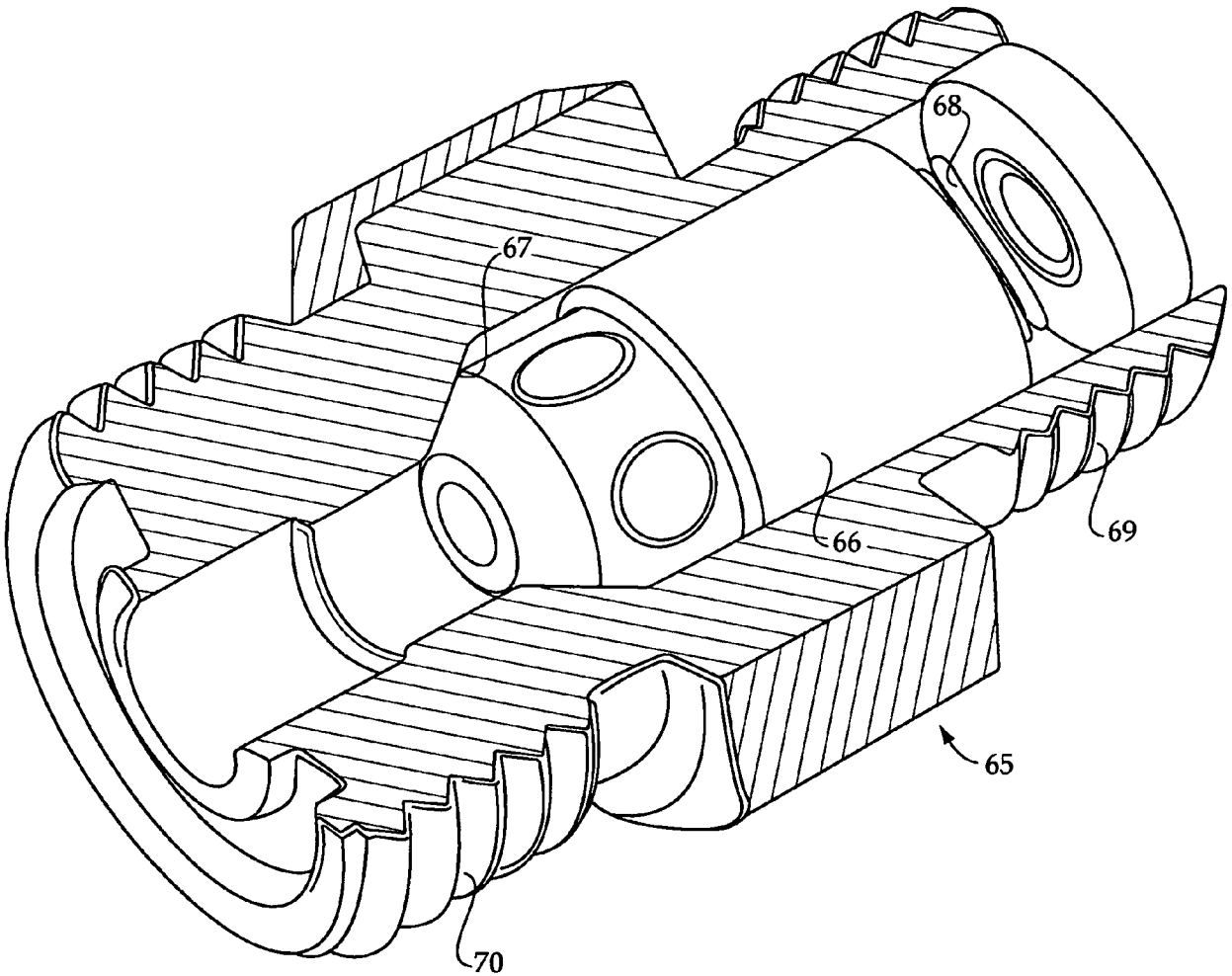
FIG. 3 is a sectioned view of an anti-drainback valve according to the present disclosure.

Referring now to FIG. 2, anti-drainback valve 65 is shown mounted outside of engine housing 11 for easy access. In particular, and referring in addition to FIG. 3, anti-drainback valve 65 includes a pair of external threads 69 and 70 to allow it to be easily positioned in an external fuel line for fuel system 14 illustrated in FIG. 1. In the illustrated embodiment, anti-drainback valve is connected in circulation line 37 just upstream from the inlet 39 to small particle filter 38, such as at a filter base. Although anti-drainback valve 65 can take on a variety of forms, it is preferably a poppet style valve that includes a valve member 66 that is urged into contact to close a conical valve seat 67 via a biasing spring 68 as shown in FIG. 3. Thus, many off-the-shelf type valves may be suitable for use in anti-drainback valve 65 in liquid systems according to the present disclosure.

INDUSTRIAL APPLICABILITY

Although the present disclosure is illustrated in the context of a high pressure common rail fuel system for a direct injection diesel type engine, the present disclosure is not so limited. In particular, the anti-drainback valve of the present disclosure may be part of any liquid system for an engine, including hydraulic systems, and may also find application in other types of engines including but not limited to spark ignited engines. The present disclosure finds particular application in any liquid system for an engine that includes a bleed line to facilitate evacuation of air or vapor that may have entered the liquid system due to servicing and/or a prolonged engine shut down period. The anti-drainback valve of the present disclosure may be positioned anywhere between the pump side of bleed orifice 48 and the tank 15. However, the present disclosure recognizes that there may be more advantageous locations for the anti-drainback valve. For instance, in the common rail fuel system 14 illustrated in FIG. 1, the fuel transfer pump 16 continuously produces an excess amount of fuel which is at some supply rate when the engine is running. Some of that supply rate is provided to the high pressure pump 17 at a regulated pressure, and the remaining portion of the supply rate is simply recirculated back through fuel transfer pump 16. Preferably, the fuel recirculated by the fuel transfer pump is done upstream from the anti-drainback valve of the present disclosure. By doing so, the fuel system 14 experiences a virtually negligible adverse effect by adding the anti-drainback valve 65 to fuel system 14. Those skilled in the art will appreciate that the anti-drainback valve 65 essentially amounts to another flow restriction in the fuel system 14. However, by positioning the anti-drainback valve downstream from the recirculation features associated with the fuel transfer pump 16, any adverse effects by the anti-drainback valve may be addressed by the excess flow produced by the fuel transfer pump. In addition, only the fuel that is supplied to the high pressure pump 17 need be pushed through the anti-drainback valve. Nevertheless, those skilled in the art will appreciate that there are numerous other locations in fuel system 14 where the anti-drainback valve may be located and still function for its purpose of preventing the reverse flow of vapor from tank 15 into fuel system 14 during prolonged engine shut down, without departing from the scope of the present disclosure. In addition, the anti-drainback valve of the present disclosure can be added to existing fuel systems, such as being attached to the filter base of the small particle filter 38 as shown in FIG. 2. This strategy allows for the anti-drainback valve to be easily incorporated without redesigning virtually any aspect of the entire fuel system. Nevertheless, those skilled in the art will appreciate that the present disclosure also applies to other structures including but not limited to incorporating the anti-drainback valve into the structure of the pressure regulating valve 47, by adding a spring bias to one of the check valves 23 or 24, actually incorporating the anti-drainback check valve into the filter base structure for one of the particle filters 27 and 38, or any other suitable location and/or structure known in the art.

If the fuel system 14 of FIG. 1 did not include the anti-drainback valve 65 of the present disclosure, one could expect fuel vapor to migrate from tank 15 toward pumps 16 and 17 during prolonged periods of engine shut down. This migration may be due to thermal contraction and/or the action of gravity, or for any other reason known in the art. In such a circumstance, the fuel vapor does not harm the fuel system, but an operator may perceive a problem when they go to start engine 10. In such a case, they might experience rather long cranking times on the order of 3-10 seconds in order for the pumps 16 and 17 to push the vapor back through bleed orifice 48 and through bleed line 50 back to tank before the system pressure can rise up to levels suitable for injection of fuel and starting the engine. However, if the fuel vapor is prevented from migrating past bleed orifice 48 toward pump 16 and 17 in the first place, an operator could expect to experience relatively short cranking times on the order of less than three seconds in order to start engine 10. Thus, by the inclusion of anti-drainback valve 65, the perception of a problem associated with long cranking times can be avoided. The closure of anti-drainback valve 65 during engine shut down, substantially prevents vapor from migrating up through bleed line 50 towards pumps 16 and 17 since the fuel that the vapor would otherwise displace is prevented from being drained back to tank by the closure of anti-drainback valve 65. By locating the anti-drainback valve downstream from the recirculation features associated with the fuel transfer pump 16 but upstream from high pressure pump 17, the fuel system 14 may experience little to no performance degradation by the inclusion of the anti-drainback valve.

It should be understood that the above description is intended for illustrative purposes only, and is not intended to limit the scope of the present invention in any way. Thus, those skilled in the art will appreciate that other aspects of the invention can be obtained from a study of the drawings, the disclosure and the appended claims.

What is claimed is:

1. A liquid system for an engine, comprising:

a tank;

a low pressure transfer pump with an inlet fluidly connected to the tank;

a high pressure pump with an inlet fluidly connected to an outlet of the transfer pump, and an outlet fluidly connected to the fuel tank via a bleed line with an always open bleed orifice having pump side adjacent the outlet of the high pressure pump;

a high pressure reservoir with an inlet fluidly connected to the outlet of the high pressure pump; and an anti-drainback valve fluidly positioned between a pump side of the bleed orifice and the outlet of the transfer pump.

2. A liquid system for an engine, comprising:

a tank;

a low pressure transfer pump with an inlet fluidly connected to the tank;

a high pressure pump with an inlet fluidly connected to an outlet of the transfer pump, and an outlet fluidly connected to the fuel tank via a bleed line with a bleed orifice having pump side adjacent the outlet of the high pressure pump;

a high pressure reservoir with an inlet fluidly connected to the outlet of the high pressure pump;

an anti-drainback valve fluidly positioned between a pump side of the bleed orifice and the tank;

the tank contains fuel and vapor;

the inlet of the transfer pump being fluidly connected to the fuel in the tank;

the bleed line being fluidly connected to the vapor in the tank;

a large particle filter fluidly positioned between the inlet of the transfer pump and the tank:

a small particle filter fluidly positioned between an inlet of the high pressure pump and an outlet of the transfer pump;

the anti-drainback valve being fluidly positioned between the large particle filter and the small particle filter;

the bleed orifice is part of a pressure regulating valve;

a recirculation line with an inlet fluidly connected to the outlet of the transfer pump, and an outlet fluidly connected to the inlet of the transfer pump; and a recirculation valve positioned in the recirculation line;

the inlet of the recirculation line is fluidly connected upstream from the anti-drainback valve;

the anti-drainback valve includes a valve body with two sets of external threads; and a valve member biased toward contact with a valve seat of the valve body via a compression spring.

3. An engine comprising:

a housing with a plurality of combustion chambers disposed therein;

a common rail fuel system attached to the housing and including a bleed line to a fuel tank and an anti-drainback valve operably positioned in the fuel system to prevent fuel vapor from migrating from a the fuel tank to a pump when the engine is shut down;

the anti-drainback valve, which includes a biasing spring, is threadably attached to a filter base, and fluidly positioned between an outlet of a low pressure transfer pump and an inlet of a high pressure pump.

4. The engine of claim 3 wherein the anti-drainback valve is exposed outside the housing.

5. An engine comprising:

a housing with a plurality of combustion chambers disposed therein;

a common rail fuel system attached to the housmnn and including a bleed line to a fuel tank and an anti-drainback valve operably positioned in the fuel system to prevent fuel vapor from migrating from the fuel tank to a pump when the engine is shut down;

the anti-drainback valve is exposed outside the housing;

the anti-drainback valve includes a valve body with two sets of external threads; and a valve member biased toward contact with a valve seat of the valve body via a compression spring.

6. The engine of claim 5 wherein the common rail fuel system includes:

a fuel transfer pump with an inlet fluidly connected to the fuel tank;

a high pressure pump with an inlet fluidly connected to an outlet of the fuel transfer pump, and an outlet fluidly connected to the fuel tank via the bleed line, which includes a bleed orifice;

a high pressure common rail with an inlet fluidly connected to the outlet of the high pressure pump;

a large particle filter fluidly positioned between the inlet of the transfer pump and the fuel tank;

a small particle filter fluidly positioned between an inlet of the high pressure pump and an outlet of the fuel transfer pump;

the anti-drainback valve being fluidly positioned between the large particle filter and the small particle filter; and a fuel injector positioned for direct injection into each of the plurality of combustion chambers, and including an inlet fluidly connected to an outlet of a common rail.

7. The engine of claim 6 wherein the common rail fuel system includes a recirculation line with an inlet fluidly connected to the outlet of the fuel transfer pump, and an outlet fluidly connected to the inlet of the fuel transfer pump; and a recirculation valve positioned in the recirculation line.

8. The engine of claim 7 wherein the inlet of the recirculation line is fluidly connected upstream from the anti-drainback valve.

9. The engine of claim 8 wherein the bleed orifice is part of a pressure regulating valve.

10. A method of operating an engine, comprising the steps of:

evacuating vapor from a fuel line of a common rail fuel system to a fuel tank via an always open bleed line when a fuel transfer pump is moving;

reducing performance degradation due to an inclusion of the anti-drainback valve in the common rail fuel system when the engine is running by locating the anti-drainback valve fluidly between the fuel transfer pump and a high pressure common rail pump; and preventing migration of vapor from the fuel tank through the bleed line toward the fuel pump when the engine is shut down by closing an anti-drainback valve of the common rail fuel system with a spring.

11. The method of claim 10 including a step of pumping fuel at a supply rate with a fuel transfer pump when the engine is running;

receiving less than all of the supply rate at an inlet of a high pressure pump when the engine is running; and recirculating a remaining portion of the supply rate back through the fuel transfer pump.

12. The method of claim 11 wherein the recirculating step is performed upstream from the anti-drainback valve.

13. The method of claim 12 including a step of locating the anti-drainback valve at an accessible location outside of an engine housing via a threaded attachment to a filter base.

14. The method of claim 13 including a step of cranking the engine for less than three seconds when starting the engine.

15. The engine of claim 1, wherein the anti-drainback valve includes a valve body with two sets of external threads; and a valve member biased toward contact with a valve seat of the valve body via a compression spring.

16. The engine of claim 1 wherein the anti-drainback valve is threadably attached to filter base upstream from a filter attached to the filter base.

17. The engine of claim 16 wherein the filter base is fluidly positioned between the outlet of the transfer pump and the inlet of the high pressure pump.

18. The engine of claim 1 wherein the anti-drainback valve includes a valve member biased into contact with a valve seat via a compression spring.

19. The engine of claim 18 wherein the anti-drainback valve is threadably attached to filter base upstream from a filter attached to the filter base; and the filter base is fluidly positioned between the outlet of the transfer pump and the inlet of the high pressure pump.

* * * * *